United States Patent [19]

Koval

[11] 3,935,409

[45] Jan. 27, 1976

[54] CURRENT-LIMITING CIRCUIT BREAKER

[75] Inventor: Leonide P. Koval, Far Rockaway, N.Y.

[73] Assignee: General Electric Company, New York, N.Y.

[22] Filed: Nov. 12, 1973

[21] Appl. No.: 414,648

Related U.S. Application Data

[62] Division of Ser. No. 195,739, May 18, 1962, Pat. No. 3,813,619.

[52] U.S. Cl. ..... 200/153 G

[51] Int. Cl. ..... H01h 3/00

[58] Field of Search..... 200/153 R, 153 G, 153 H, 200/324, 325

[56] References Cited

UNITED STATES PATENTS

| | | | |
|---|---|---|---|
| 3,783,215 | 1/1974 | Brumfield | 200/153 G |
| 3,805,199 | 4/1974 | Tazuki | 200/153 G X |
| 3,849,751 | 11/1974 | Link et al. | 200/153 G X |

*Primary Examiner*—James R. Scott
*Assistant Examiner*—William J. Smith
*Attorney, Agent, or Firm*—Robert A. Cahill; Walter C. Bernkopf; Frank L. Neuhauser

[57] ABSTRACT

An electric circuit breaker includes thermal magnetic trip means for causing circuit interruption upon the occurrence of overload and minor short-circuit conditions, and also provides current limiting action under major short-circuit conditions by providing two pairs of engageable contacts, wherein one contact of each pair is movable to a circuit interrupting position by the circuit breaker operating mechanism and the other contact of each pair is magnetically attracted to a circuit interrupting position in response to short-circuit currents exceeding a predetermined magnitude.

5 Claims, 5 Drawing Figures

CURVES "A": CONVENTIONAL CIRCUIT BREAKER

CURVES "B": CURRENT-LIMITING CIRCUIT BREAKER

CURRENT-LIMITING CIRCUIT BREAKER

This is a division of application Ser. No. 195,739, filed May 18, 1962, now U.S. Pat. No. 3,813,619.

Electric circuit breakers in accordance with the prior art have included means for causing automatic opening of the contacts upon the occurrence of predetermined sustained overload current conditions, such means usually comprising thermally responsive means such as a bimetallic strip. In addition, prior art circuit breakers have included means for causing more rapid opening of the circuit breaker contacts upon the occurrence of high overload or minor short-circuit current conditions, such opening means normally comprising magnetically operable means for or causing automatic opening of the circuit breaker.

While prior art circuit breakers have included means for causing automatic opening on the occurrence of either of the aforesaid two types of abnormal current conditions, such circuit breakers have not been capable of providing a current-limiting action on the occurrence of extremely high short-circuit currents.

As used herein, the term "current-limiting" is used to mean that the electric current is not permitted to rise to the levels to which it would otherwise rise if the only impedance elements in the circuit were the source impedance and the normal impedance of the circuit breaker itself. Such level may be referred to as the peak of the "prospective" short-circuit current. Thus, for example, when a "dead short-circuit" condition exists in a circuit incorporating an electric circuit breaker, the only elements tending to limit the rise of electric current in the circuit are the impedance of the source, the impedance of the lines connecting the source to the circuit breaker, and the impedance of the circuit breaker itself, including the impedance, if any, of arcs drawn by the circuit breaker in the time which the current requires to rise to its potentially highest value.

Electric circuit breakers of known prior art construction include automatic opening means which involves parts having a mass or weight such that movement thereof at a speed sufficiently high to introduce a true current-limiting action is not possible.

This is especially true of circuit breakers of medium and high current capacity, such as 800–1,000 amperes or more, which require high contact pressure, with correspondingly large and heavy operating mechanisms.

It is an object of the present invention to provide an electric circuit breaker of medium or high capacity including thermal and magnetic means for causing automatic opening of the circuit breaker upon the occurrence of overload current conditions of predetermined magnitude and of electrical short-circuit conditions of predetermined magnitude, and also including means providing a "current-limiting" action upon the occurrence of predetermined short-circuit current conditions above a predetermined magnitude.

It is another object of the invention to provide an electric circuit breaker including contacts which are movable upon the occurrence of extremely high short-circuit current conditions without requiring movement of other mechanism parts having an extremely high inertia.

In accordance with the invention, an electric circuit breaker is provided, including relatively movable contacts and manually operable operating mechanism for operating such contacts between "open" and "closed" tripping circuit conditions. Current-responsive means is also provided for moving the contacts to "open" position upon the occurrence of either sustained minor overload conditions or minor short-circuit conditions. In addition, there is provided, in accordance with the invention, means for instantaneously causing relative opening movement of such contacts upon the occurrence of high short-circuit conditions. Such opening movement, moreover, is accomplished by movement of one or more of such contacts per se, without requiring movement of the main operating mechanism.

In accordance with a further aspect of the invention, the contact so moved is mechanically held in its instantaneously opened position at least until the main operating mechanism has had time to move to its automatically opened position following operation of its current-responsive tripping means.

The invention will be more fully understood from the following detailed description, and its scope will be pointed out in the appended claims.

Figure 1:
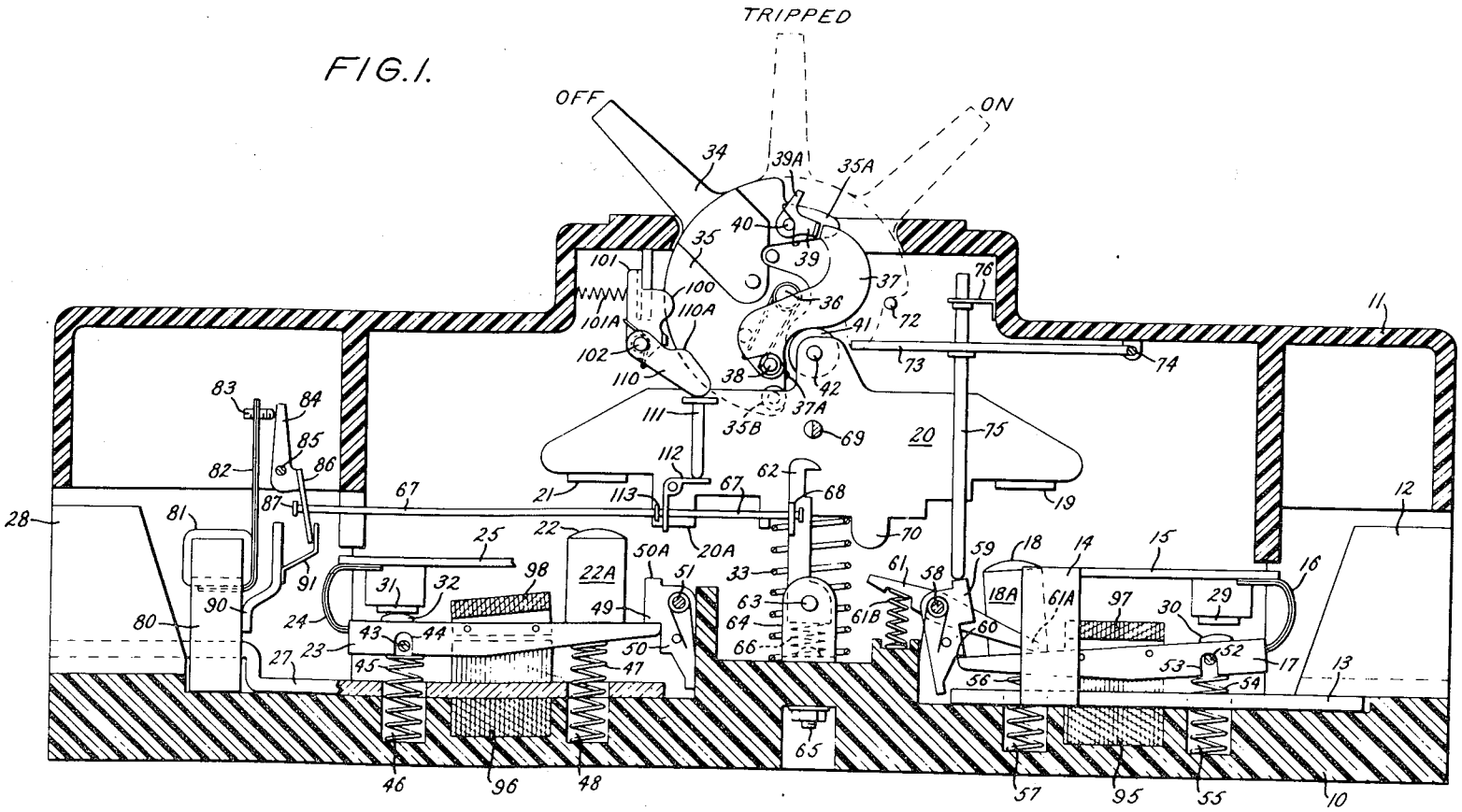
FIG. 1 is a side elevation view, partly in section, of an electric circuit breaker in accordance with the invention, shown in the normal "off" condition.
Figure 3:
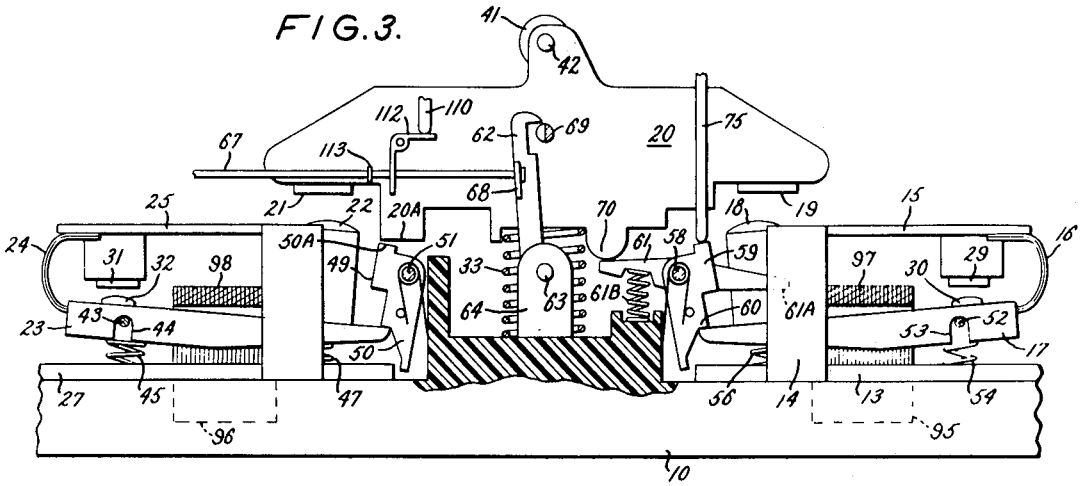
Figure 4:
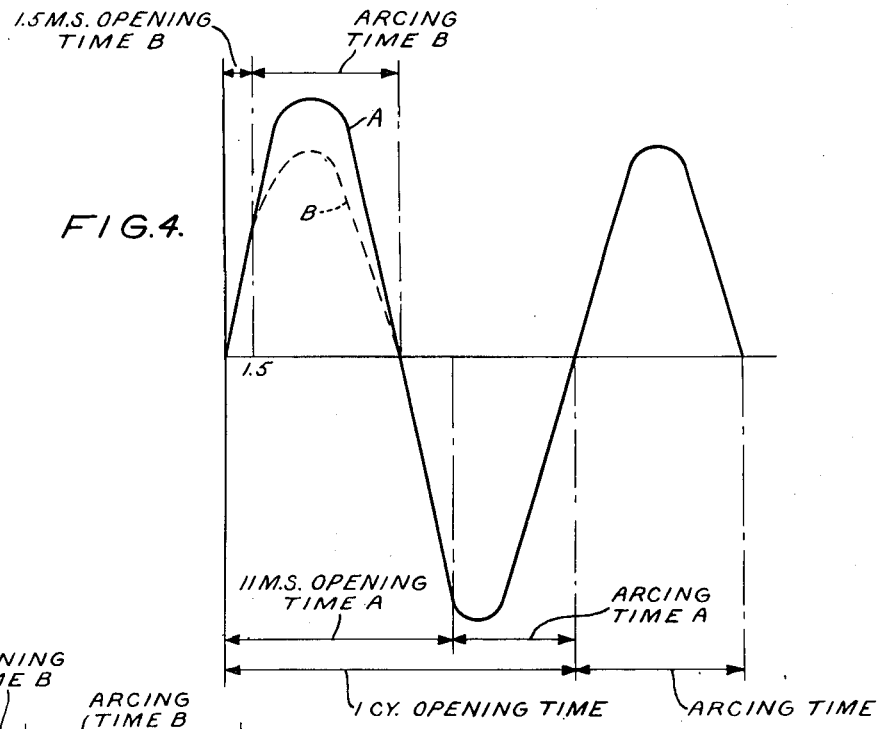
Figure 5:
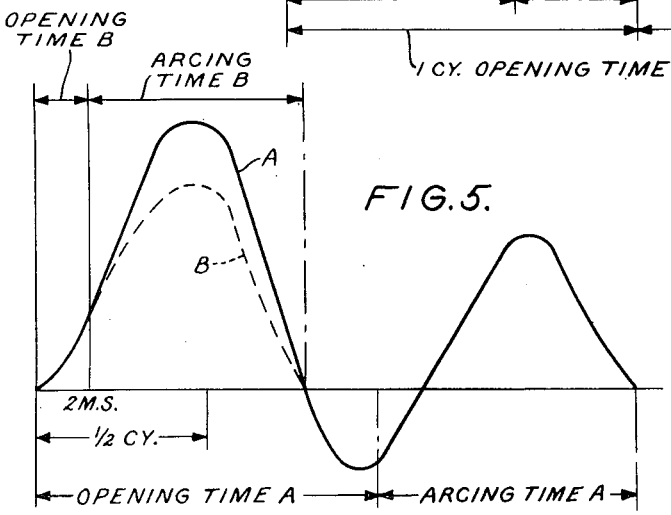

FIG. 3 is an elevation view of a portion of the circuit breaker of FIG. 1, the parts being shown in a transient position, illustrating the current-limiting action, and FIGS. 4 and 5 are representations in graph form of current conditions which may be expected to exist in circuit breakers in accordance with the prior art, and in circuit breakers incorporating the present invention, under "short-circuit" conditions.

Referring to FIG. 1, the invention is shown as incorporated in an electric circuit breaker comprising an insulating enclosure having a base 10 and a cover 11. An incoming or "line" lug or cable connector 12 is fixedly mounted on the base 10 by suitable means, not shown, and is conductively connected to an elongated line terminal strap 13. The line terminal 13 has an upright conductive member 14 attached thereto adjacent its inner end, having an extension 15 extending parallel to the terminal strap 13. The extension 15 is connected by a flexible conductor member 16 to a first movable contact arm 17, having a first movable contact member 18 supported on a contact support 18A.

The movable contact 18 is adapted to engage a second movable contact member 19 carried by a bridging contact carrier 20. The contact carrier 20 has a third movable contact member 21 mounted thereon and adapted to engage a fourth movable contact 22. The movable contact 22 is supported by a contact support 22A on a second contact arm 23. The contact arm 23 is connected by a flexible conductor 24 to a conductive member 25, shown partially broken away, which is connected to an upright conductive member, not shown, which in turn is connected to an outgoing terminal strap 27. The outgoing terminal strap 27, at its outer end, is connected to an outgoing or load terminal member 28.

The flexible conductor 16 connecting the contact arm 17 and the conductive member 15 is shunted by a pair of contacts 29, 30, which in the closed condition of the circuit breaker serve to carry a portion of the current in parallel with the conductor 16 in a manner to be described. Similarly, the flexible conductor 24 has a pair of contacts 31, 32 in parallel therewith and serving to carry a portion of the current from the contact arm 23 to the connective member 25 in closed condition of the circuit breaker. The provision of the supplementary contacts 31, 32 and 29, 30, makes possible the use of lighter flexible connectors 24, 16, respectively than would otherwise be required, since a large portion of the current is carried by the contacts rather than the flexible conductor. At the same time, arcing between the contacts 31, 32, when opening, is avoided by the presence of the flexible connectors conductors 16 and 24.

Figure 2:
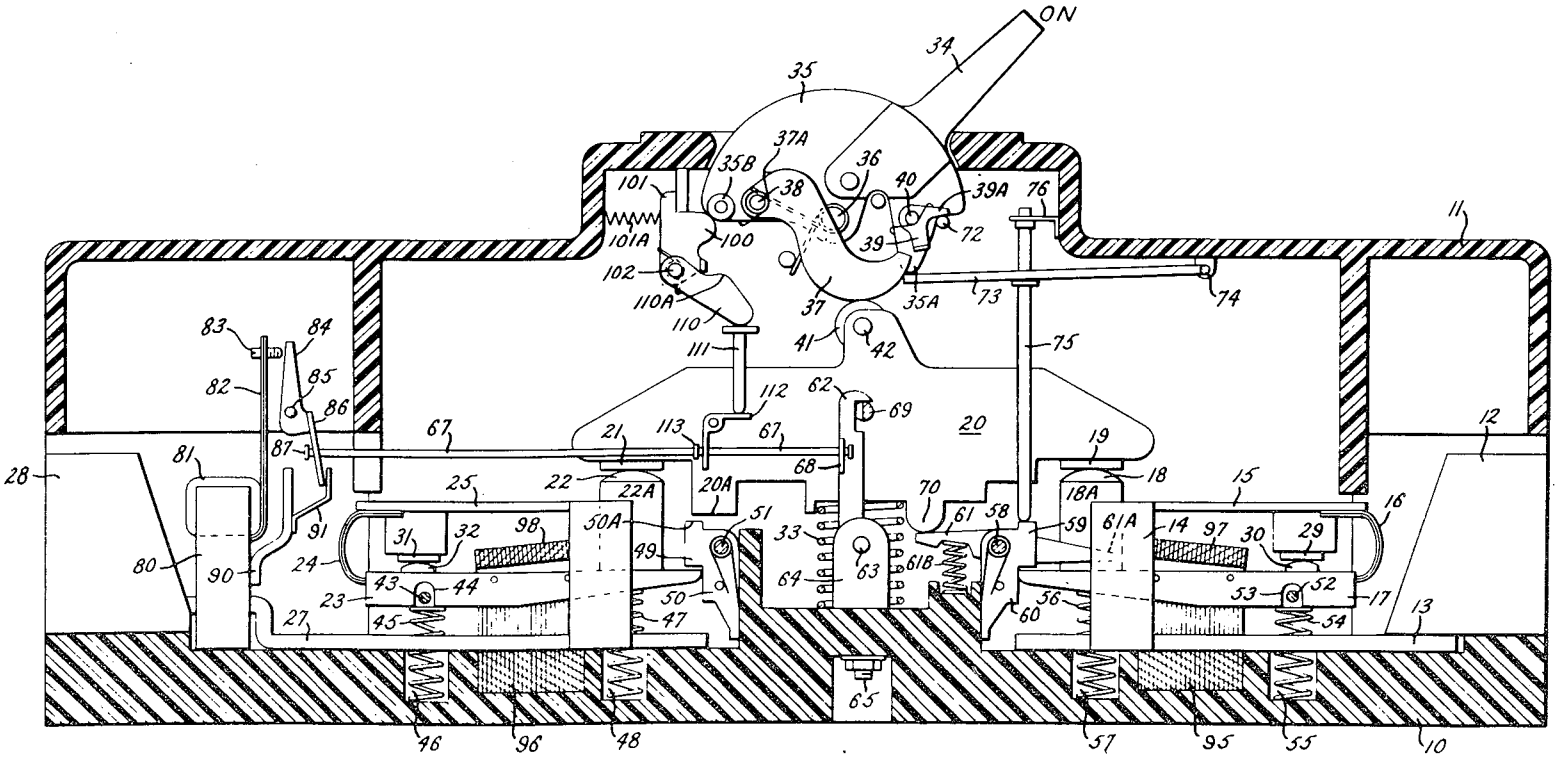
FIG. 2 is a view similar to FIG. 1, the parts being shown in "on" position.

The movable contact carrier 20 is movable in straight-line reciprocal fashion vertically between the "OFF" position as shown in FIG. 1 and the "ON" position as shown in FIG. 2. The contact carrier 20 is biased to the upward, "OFF" position as shown in FIG. 1 by a suitable means such as by a compression spring 33.

For the purpose of manually moving the contact carrier 20 from the "OFF" position as shown in FIG. 1 to the "ON" position as shown in FIG. 2, mechanism is provided including a pivotally supported manually engageable handle member 34 rigidly carried by a handle support member 35 pivotally supported in the cover 11 on a pivot pin 36 in the cover 11. The handle support member 35 has an actuating cam member 37 pivotally supported thereon at 38 at one end, and having a releasable engagement with a pivotally supported latch member 39 at the other end. The latch member 39 is supported on a pivot pin 40 on the handle support member 35, and is constantly biased to the latching position as shown in FIG. 1 by suitable spring means, not shown.

As the handle member 34 is moved in clockwise direction as viewed from the "OFF" position as shown in FIG. 1, the cam member 37 engages a roller member 41 supported at 42 on the contact carrier 20, and cams the contact carrier 20 downwardly against the force of the compression spring 33.

The movable contact arm 23 is resiliently and floatingly supported, being guided laterally by suitable guide portions, and pivotally supported on a pivot pin 43, extending through an elongated slot 44 in the contact arm. A compression spring 45 is seated in a recess 46 in the base 11 and urges the left-hand end of the contact arm 23 upwardly. A second compression spring 47, seated in a recess 48, engages the forward end of the contact arm 23 and urges it upwardly against a stop portion 49 of a catch member 50 pivotally supported on a pin 51 in the base 11, for a purpose to be described.

The movable contact arm 17 is similarly pivotally supported on a pivot pin 52 extending through an elongated slot 53 in the contact arm. A compression spring 54 is seated in a recess 55 of the base 11 and urges the right-hand portion of the contact arm 17 upwardly as shown. A second compression spring 56 is seated in a recess 57 and urges the left-hand end of the contact arm 17 upwardly as shown.

The contact arm 17 is adapted to be held in a depressed condition by means of a lever 61 which is pivotally supported on a pivot pin 58, and which is urged in a clockwise direction by a strong compression spring 61B. The right-hand end 61A of the lever 61 engages the left-hand end of the movable contact 17 and depresses it to the position shown when the contact carrier 20 is in the upward position. A latch member 59 is also provided, likewise pivoted on the pin 58, and having a first shoulder portion 60 adapted to overly the end of the contact arm 17 when the arm 17 is in depressed condition as shown in FIG. 1.

For the purpose of releasably restraining the contact carrier 20 in closed circuit position as shown in FIG. 2, in a manner to be described, an elongated pivoted latch member 62 is provided, pivotally supported at 63 on a support bracket 64 rigidly attached to the base 11 by suitable means such as by bolt 65. The latch 62 is resiliently biased to vertical, latching, position as shown in FIG. 1 by means of a compression spring 66. The contact carrier 20 is provided with a catch projection 69 for cooperation with the latch 62.

For the purpose of retracting the latch member 62 upon the occurrence of predetermined electrical conditions in the circuit, in a manner to be described, an elongated tripping rod 67 is provided, slidably engaging a projection 68 on the latch member 62.

MANUAL CLOSING

In operation, the parts are moved from the "OFF" position as shown in FIG. 1 to the "ON" position as shown in FIG. 2 in the following manner. The handle member 34 is moved clockwise from the position shown in FIG. 1, causing the cam 37 to engage the roller 41 of the contact carrier 20, thereby depressing the contact carrier 20 against the force of the compression spring 33.

During this movement, the movable contact 21 first engages the contact 22. It will be observed, however, that no complete circuit exists at this time, due to the fact that the movable contact 18 is retained in depressed condition by its engagement with the shoulder 60 of the latch member 59.

In its continued movement, the contact carrier 20, through the agency of a projection 70, engages the end of the lever 61, depressing it against the force of the spring 61B, and lifting the right-hand end 61A away from the movable contact member 17. The movable contact member 17, however, remains in depressed position, due to the fact that its end portion is in latched engagement with the shoulder 60 of the latch member 59.

As the contact carrier is moved downwardly, the catch 69 passes below the retaining lip of the latch member 62. On further travel of the handle member, the leg 39A of the pivoted latch member 39 engages a stationary pin 72, causing the latch member 39 to be retracted from the cam member 37. The contact carrier 20 thereupon commences a reverse, upward, movement, due to the compression spring 33. This movement, however, continues only until the catch member 69 engages the overhanging lip of the latch member 62. At this point, the parts, with the exception of the handle assembly and the contact arm 17, are substantially in the position as shown in FIG. 2.

The circuit breaker has not yet closed at this point. A further amount of remaining clockwise travel of the handle 34 causes a projection 35A of the handle support 35 to engage an end of a lever 73 pivotally supported at 74 in the casing cover 11. The lever 73 has an engagement, at an intermediate point thereof, with a vertically extending rod 75 slidably supported in a bracket 76 carried by the cover 11. Depression of the lever 73 thereby causes depression of the rod 75, which acts upon the latch member 59, rotating it in a clockwise direction, thereby withdrawing the shoulder 60 from the contact arm 17. This permits the spring 57 to quickly move the left-hand end of the contact arm 17 upwardly, together with the movable contact 18, to closed circuit position, as shown in FIG. 2, completing the circuit through the circuit breaker.

MECHANISM TRIPPING MEANS — THERMAL

For the purpose of causing automatic opening of the mechanism upon the occurrence of predetermined current conditions in the circuit, tripping means is provided, including a generally ring-shaped magnetic core member 80 through which the load terminal strap 27 projects. The core 80 carries a "short-circuited" turn or loop 81 of highly conductive material such as copper. A thermally responsive bimetallic strip 82 is rigidly attached to the member 81 at one side thereof by suitable means such as by brazing, and carries an adjusting or calibrating screw 83 at the outer end thereof. The terminal strap 27 acts as a primary winding for the magnetic core 80, and the member 81 acts as a short-circuited secondary winding on the same core 80. A high current through the terminal strap 27, therefore induces currents in the secondary turn 81. The current in the secondary turn 81 causes heat therein, which is transmitted by conduction to the bimetallic strip 82. The bimetallic strip 82 is disposed and arranged to warp toward the right as viewed in FIG. 1 upon the occurrence of predetermined high current conditions through the circuit breaker, and to engage the upper end of a trip bar 84 pivotally supported at 85 in the casing cover 11. This rotates as armature portion 86 of the trip bar clockwise as shown, causing it to engage a headed portion 87 of the trip rod 67, moving the rod 67 to the left, and withdrawing the latch member 62 from latched position, thereby causing opening of the circuit.

MECHANISM TRIPPING MEANS — MAGNETIC

For the purpose of obtaining more rapid tripping on the occurrence of high current conditions, such as short-circuit conditions, the magnetic core member 80 is provided with a pair of pole extensions 90, only one shown. The pole extensions 90 include secondary extensions 91 which serve as a stop to limit counterclockwise rotation of the armature portion 86. The secondary extensions 91 also serve as "back drag" magnetic poles, serving normally to retain the armature 86 in the position shown in FIG. 1 until certain predetermined high current conditions occur. Upon the occurrence of predetermined high short-circuit current conditions, the armature 86 is attracted to the main pole portions 90, thereby rotating in a clockwise direction about the pivot 85, and moving the trip rod 67 to the left as viewed, causing tripping.

CURRENT-LIMITING ACTION

For the purpose of providing ultra-rapid opening action of the contacts in response to exceptionally high short-circuit conditions, so as to provide a current-limiting action, there is provided, in accordance with the invention, means for causing an initial separation of the contacts prior to movement of the main contact carrier 20. For this purpose, there is provided, surrounding each of the movable contact arms 17 and 23 respectively, a stationary magnetic core member 95, 96, respectively. The contact arm 17 is provided with an armature member 97 rigidly attached thereto by suitable means, not shown. Similarly, the contact arm 23 is provided with an armature member 98 rigidly attached thereto by similar means.

Upon the occurrence of extremely high short-circuit current conditions, each of the armatures 97 and 98 is drawn to its corresponding magnetic core member 95, 96, thereby moving the corresponding contact arm 17, 23, downwardly, moving the movable contacts 18 and 22 to a downwardly retracted open position, as shown in FIG. 3. When the contact arms 17 and 23 are drawn downwardly in this manner, they are engaged and latched in depressed position by the latches 59 and 50, respectively. This action takes place irrespective of, and ordinarily precedent to, automatic opening of the main mechanism, including the movable contact member 20.

It will be observed that by means of the arrangement shown, each of the magnetic assemblies is provided with two turns energizing it. Thus, for example, with reference to the magnetic core member 95, it will be observed that the terminal strap 13 extends through the magnetic member 95, and from thence the current path is through the vertical member 14 to the horizontal member 15 through the flexible conductor 16 to the contact arm 17, which again passes through the magnetic member 95. Thus two energizing turns are provided between the magnetic field piece 95 and the armature 97.

Since the mass of the contact arms 17 and 23, together with the movable contacts 18 and 22 and their supporting posts 18A and 22A is relatively small compared to the mass of the tripping mechanism comprising the contact carrier 20 and the associated tripping mechanism, these parts can respond much more quickly to the magnetic action caused by a short-circuit current.

Following movement of the contact arms 17 and 23 to the downward, latched, position as shown in FIG. 3, and operation of the trip rod 67, the main contact carrier 20, being unlatched, moves to its upward or tripped position, as shown in FIG. 1. When the contact arms 17 and 23, and their associated contacts 18 and 22, are drawn downwardly as shown in FIG. 3, electric arcs are drawn between the pairs of contacts 18, 19, and 21, 22.

This action takes place with such rapidity that the impedance of the aforementioned arcs is inserted in the circuit within approximately 2 micro-seconds after incidence of a short-circuit, as indicated graphically in FIG. 4, and before the main contact bar has had time to move upwardly.

This was confirmed by actual time measurements. Thus measurements were made upon a circuit breaker of the type shown, with sensing electrodes positioned so as to produce, on an oscillogram, an indication of the exact time of (a) the beginning and duration of the short-circuit current, (b) the beginning of downward movement of the retractable current-limiting contacts, (c) the end of downward movement of the retractable contacts, (d) the beginning of upward movement of the bridging contact carrier 20, and (e) the end of upward movement of the bridging contact carrier 20. The corresponding time intervals measured are listed in Table I below.

TABLE I

| Event | | Time in micro-seconds Test 1 | Test 2 |
|---|---|---|---|
| Beginning of short-circuit current | | 0.000 | 0.000 |
| Armature No. 1 | Begin movement | 1.668 | 1.338 |
| | Complete movement | 7.220 | 6.825 |
| | Total time of movement | 5.552 | 5.487 |
| Armature No. 2 | Begin movement | 1.850 | 1.613 |
| | Complete movement | 6.740 | 6.250 |
| | Total time of movement | 4.890 | 4.637 |
| Bridging Contact Member | Begin movement | 2.33 | 3.46 |
| | Complete movement | 32.9 | 29.99 |
| | Total time of movement | 30.57 | 26.53 |

| | Current in Amperes Test 1 | Test 2 |
|---|---|---|
| Pick-up current: Armature 1 | 4085 | 4884 |
| Pick-up current: Armature 2 | 4530 | 5760 |
| Pick-up current: Bridging Contact Arm Releasing Means | 8020 | 9800 |
| Peak Short Circuit Current | 11,000 | 11,000 |

The graph of FIG. 4 shows typical current conditions during interruption of a full-symmetrical short-circuit. The graph of FIG. 5 shows typical current conditions during interruption of a full-symmetrical short-circuit.

Curve A in each of these graphs represents the value of actual current which may be expected to occur when the interruption is by means of conventional prior art circuit breaker. Curve B in each of these graphs represents the value of actual current when the interruption is by means of a current-limiting circuit breaker in accordance with the present invention.

As indicated in the graphs, the total circuit opening time, in the case of a conventional circuit breaker, may be expected to be anywhere from 16 to 28 micro-seconds. In the case of the current-limiting circuit breaker, such arcing time is reduced to from 8.33 to 14 micro-seconds. More significantly, total arcing time is proportionally reduced.

Because of the current-limiting action described, the breaker may be used in a power system which has a short-circuit capacity greater than the interrupting capacity of the basic breaker, i.e., the breaker without the current-limiting feature.

RETENTION OF HANDLE IN "ON" POSITION

When the handle 34 reaches its extreme clockwise or "on" position, as shown in FIG. 2, the roller member 35B becomes engaged with a shoulder portion 100 of a retaining member 101 pivotally supported at 102 in the cover 11. This serves to hold the handle assembly in its "on" position, against the bias of a handle return spring, not shown, which constantly tends to return the handle 34 to its initial counter-clockwise position.

When tripping occurs, and the contact carrier 20 moves upwardly, a projecting portion 20B thereof engages the toe portion 102 of the member 101, thereby rotating this member in a counterclockwise direction, and moving the retaining portion 100 away from the roller 35B. This permits the handle-return spring of the handle 34 to return the handle to the "OFF" position as shown in FIG. 1. When this occurs, a return spring 37A on the cam member 37 returns this member to its latched position as shown in FIG. 1.

MANUAL OPENING

In order to go from the "ON" position shown in FIG. 2 to the "OFF" position shown in FIG. 1 by manual operation, the handle member 34 is moved in counter-clockwise direction. During this movement the roller member 35B is moved over the shoulder 100 of the member 101 against the bias of the spring 101A. Further counter-clockwise movement of the handle 34 causes the roller 35B to engage the shoulder portion 110A of the lever 110. This causes the lower end of the lever 110 to engage the head portion of a plunger 111. The plunger 111 engages a bell-crank 112 which includes a portion engaging a stop 113 carried by the trip rod 67. This moves the trip rod 67 to the left, and moves the latch member 62 to disengaged position, permitting the contact carrier 20 to move to open-circuit position under the influence of the compression spring 33. The parts thereupon move to the "OFF" position as shown in FIG. 1.

RECLOSING FOLLOWING SHORT CIRCUIT INTERRUPTION

Following a short-circuit interruption as described above, the parts are in the condition as shown in FIG. 3, in which the contact arms 17 and 23 are locked in a depressed condition by the latch members 50 and 59. In order to reclose the circuit breaker, the handle member must first be moved to reset position. To do this, the handle member 34 is moved to the fully counter-clockwise position, permitting the cam member 37 to be reset on the latch member 39. To reclose the breaker, the handle is again rotated in clockwise direction, forcing the contact carrier 20 downwardly against the bias of the spring 33. As the contact carrier 20 moves downwardly, the projecting portion 20A engages the portion 50A of the latch member 50 and rotates the latch member 50 in a counter-clockwise direction, thereby releasing the end of the contact arm 23. This permits the contact arm 23 to be moved upwardly by the compression spring 27 to closed position of the contacts 21, 22. It will be observed, as previously noted, that the contacts 18 and 19 are not yet closed, however. Further rotation of the handle member 34 in counterclockwise direction causes the latch member 69 to become engaged with the latch retaining member 62, and also causes the projection 70 of the contact carrier 20 to engage the lever 57, rotating this to a non-obstructing position with respect to the contact arm 17. Upon further rotation of the handle member 34 the latch member 39 is moved to release position freeing the cam member 37, and allowing the contact carrier 20 to be held by the latch member 62 alone. Finally the last portion of the rotation of the handle member 34 causes the extension 35A to engage the lever 73, which in turn depresses a rod 75 which engages the latch member 59 rotating it clockwise and releasing the contact arm 17 to permit it to move to closed circuit position.

It will be seen that I have provided a circuit breaker mechanism in which means is provided for causing initial ultra-rapid separation of the movable contacts upon the occurrence of extremely high short-circuit current conditions, so as to introduce a current-limiting action, before the conventional tripping mechanism has time to operate, together with means for retaining such contacts in this open condition until the main mechanism has opened.

While the invention has been shown in only one particular embodiment, it will be appreciated that many modifications may readily be made. I therefore intend, by the appended claims, to cover all such modifications as fall within the true spirit and scope of the invention.

What I claim as new and desire to secure by letters patent of the United States is:

1. An electric circuit breaker comprising:

a an insulating enclosure, b a movable contact member movable between open and closed circuit positions, c an operating member movable between open and closed circuit positions corresponding to said open and closed circuit positions of said movable contact member, d said operating member comprising a first portion movably supported in said enclosure, e a cam member pivotally supported on said first portion of said operating member, f latch means movably mounted on said operating member and disposed to engage said cam member during at least a portion of the movement of said operating member from said open to said closed circuit position, g said latch means when in engagement with said cam member serving to retain said cam member in a position in which said cam member is operable upon said movable contact member, and h means operable upon movement of said operating member a predetermined amount to release said latch means from said cam member.

2. An electric circuit breaker comprising:

a an insulating enclosure, b a movable contact member movable between open and closed circuit positions, c a manually operable operating member movable between open and closed circuit positions corresponding to said open and closed circuit positions of said movable contact member, d said operating member comprising a first portion pivotally supported in said enclosure, e a cam member pivotally supported on said first portion of said operating member, f latch means movably mounted on said operating member and disposed to engage said cam member during at least a portion of the movement of said operating member from said open to said closed circuit position, g said latch means when in engagement with said cam member serving to retain said cam member in a position in which said cam member is operable upon said movable contact member, and h means carried by said enclosure for engaging said latch means upon a predetermined amount of pivotal movement of said first portion of said operating member to release said latch means from said cam member.

3. An electric circuit breaker comprising:

a an enclosure, b a first movable contact movably supported in said enclosure for movement between open and closed circuit positions, c a second movable contact movably supported in said enclosure and adapted to be contacted by said first movable contact when said first movable contact is in said closed circuit position, d a manually operable operating member movably supported in said enclosure and movable between open and closed circuit positions corresponding to said open and closed circuit positions of said first movable contact, e force-transmitting means between said operating member and said first movable contact member, said force transmitting means being effective to transmit force from said operating member to said first movable contact member during a first portion of said movement of said operating member from open to closed circuit positions and being ineffective to transmit force from said operating member to said first movable contact during a second portion of said movement of said operating member from open to closed position, f means for releasably holding said movable contact member in a position to which it has been moved by said operating member following said first portion of said movement of said operating member from open to closed circuit positions, f means biasing said second movable contact to a first position in which it is adapted to be contacted by said first movable contact when said first movable contact is in said closed circuit position, h means restraining said second movable contact in a retracted position against the bias of said biasing means during said first portion of said movement of said operating member, and means for releasing said restraining means following said first portion of said movement of said operating member from said open to said closed position, j whereby said second movable contact is biased into engagement with said first movable contact by said biasing means and said first movable contact member is releasably held in position to be contacted by said second movable contact independently of said operating member.

4. An electric circuit breaker as set forth in claim 3 wherein said force-transmitting means comprises a cam member pivotally supported on said operating member, latch means carried by said operating member for restraining said cam member in force-transmitting condition, and means carried by said enclosure for engaging and releasing said latch means upon completion of said first portion of movement of said operating member.

5. An electric circuit breaker as set forth in claim 3, said circuit breaker also comprising means operable by said operating member upon movement thereof to said open circuit position for causing release of said releasable holding means for said movable contact member.

* * * * *